US007165275B2

(12) United States Patent
Clark

(10) Patent No.: US 7,165,275 B2
(45) Date of Patent: Jan. 23, 2007

(54) TOILET MOUNTING ASSEMBLY

(76) Inventor: Robert D. Clark, P.O. Box 28125, San Antonio, TX (US) 78228

( * ) Notice: Subject to any disclaimer, the term of this patent is extended or adjusted under 35 U.S.C. 154(b) by 0 days.

(21) Appl. No.: 11/083,286

(22) Filed: Mar. 18, 2005

(65) Prior Publication Data

US 2006/0207001 A1 Sep. 21, 2006

(51) Int. Cl.
*E03D 11/00* (2006.01)
*E03D 11/14* (2006.01)

(52) U.S. Cl. ..... 4/252.1

(58) Field of Classification Search ..... 4/252.1, 4/252.4, 252.5, 252.2, 252.6
See application file for complete search history.

(56) References Cited

U.S. PATENT DOCUMENTS

| | | | | |
|---|---|---|---|---|
| 928,523 | A * | 7/1909 | Kelly | 4/252.1 |
| 1,202,404 | A * | 10/1916 | Minns | 4/252.1 |
| 2,673,985 | A | 4/1954 | Gay | |
| 3,360,805 | A | 1/1968 | Aumann | |
| 3,680,154 | A * | 8/1972 | Stairs | 4/420 |
| 3,896,510 | A | 7/1975 | O'Connell | |
| D255,481 | S | 6/1980 | Moore | |
| 5,018,224 | A | 5/1991 | Hodges | |
| 6,101,977 | A | 8/2000 | Matz | |
| 6,378,141 | B1 * | 4/2002 | Lew | 4/252.1 |
| 2003/0037368 | A1 * | 2/2003 | Clark | 4/252.1 |

FOREIGN PATENT DOCUMENTS

| | | |
|---|---|---|
| EP | 345610 | 6/1988 |
| GB | 2241642 | 9/1991 |

* cited by examiner

*Primary Examiner*—Huyen Le
(74) *Attorney, Agent, or Firm*—Stephen R. Greiner

(57) ABSTRACT

A toilet mounting assembly including a pedestal for fastening to a floor and a toilet snap-fit to the pedestal. The pedestal includes a plate for positioning upon a floor and having an opening in its center. An upstanding lip is affixed to the front of the plate. The lip is formed from a resilient material and has a notch in its front. An upstanding lug is affixed to the rear of the plate and has an indention in its rear. The toilet, however, includes a base for positioning upon the plate and a fluid outlet for positioning within the opening in the plate. A protrusion extends from the front of the base into the notch in the lip after the protrusion temporarily deforms the lip to gain access to the notch. A projection extends from the rear of the base into indention in the lug.

7 Claims, 2 Drawing Sheets

FIG. 1
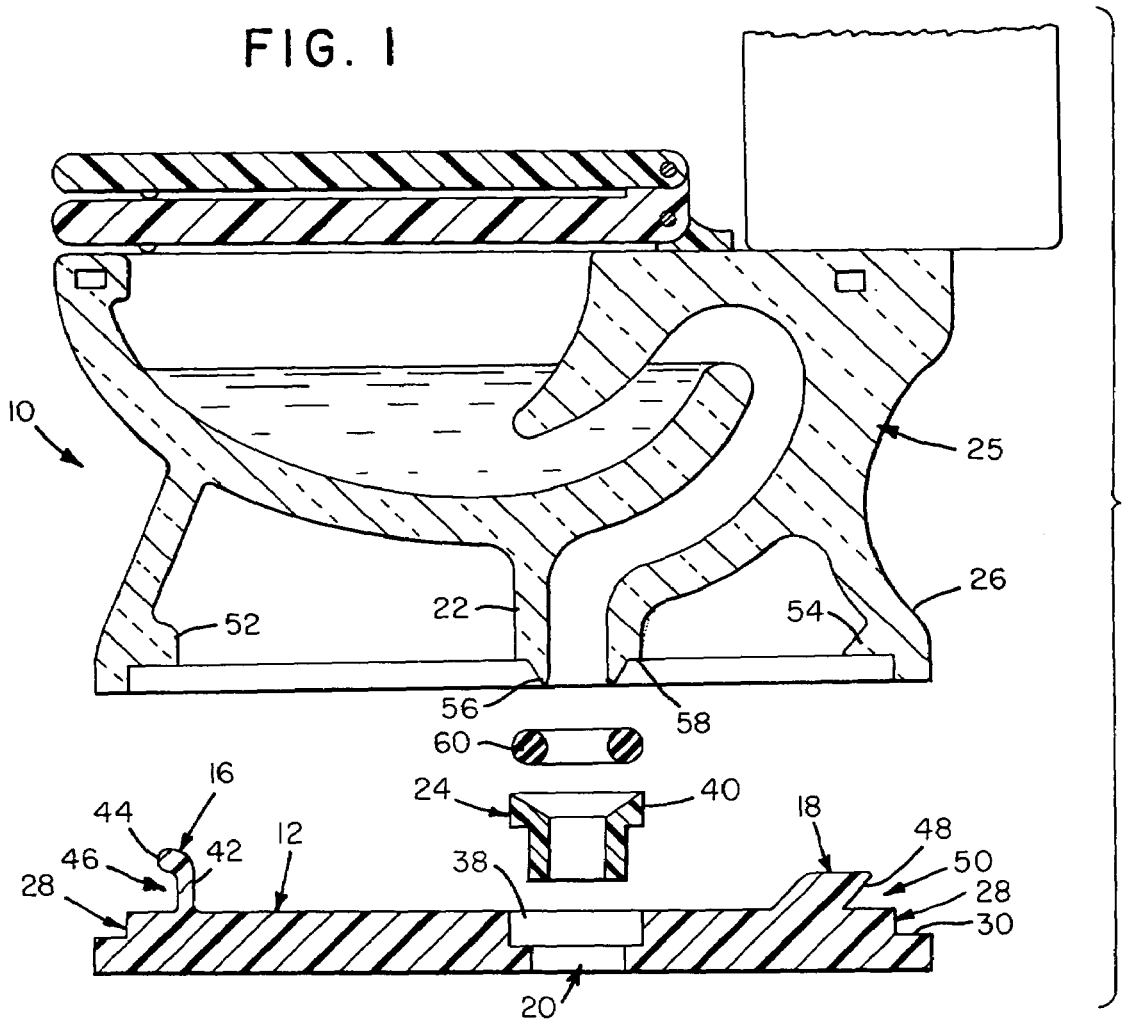
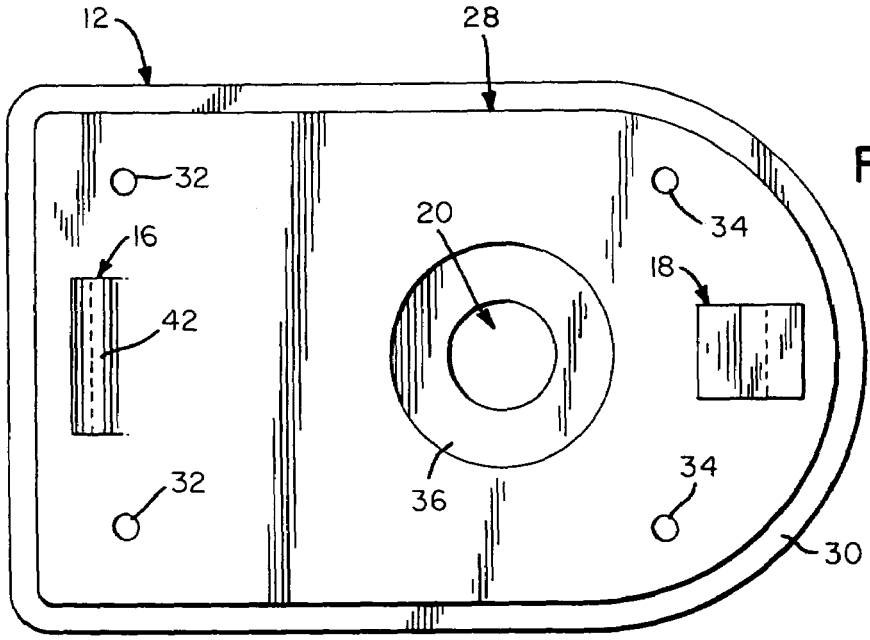
FIG. 2

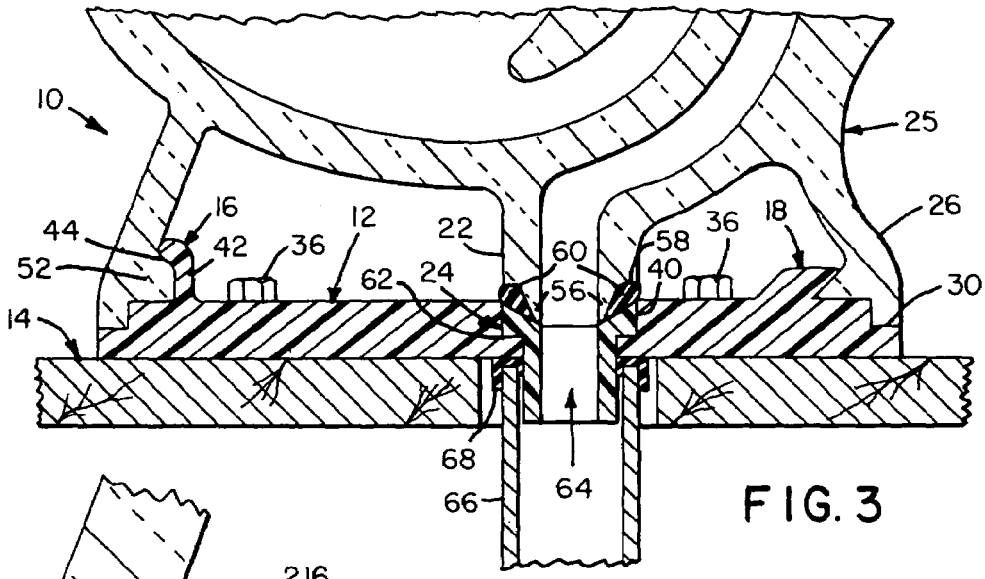
FIG. 3
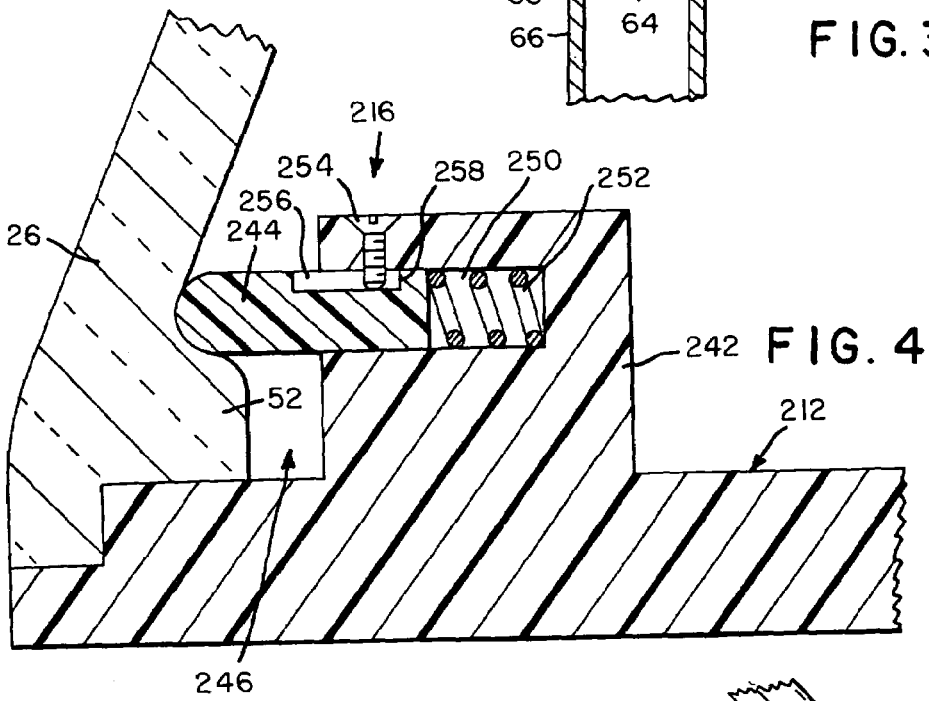
FIG. 4
FIG. 5
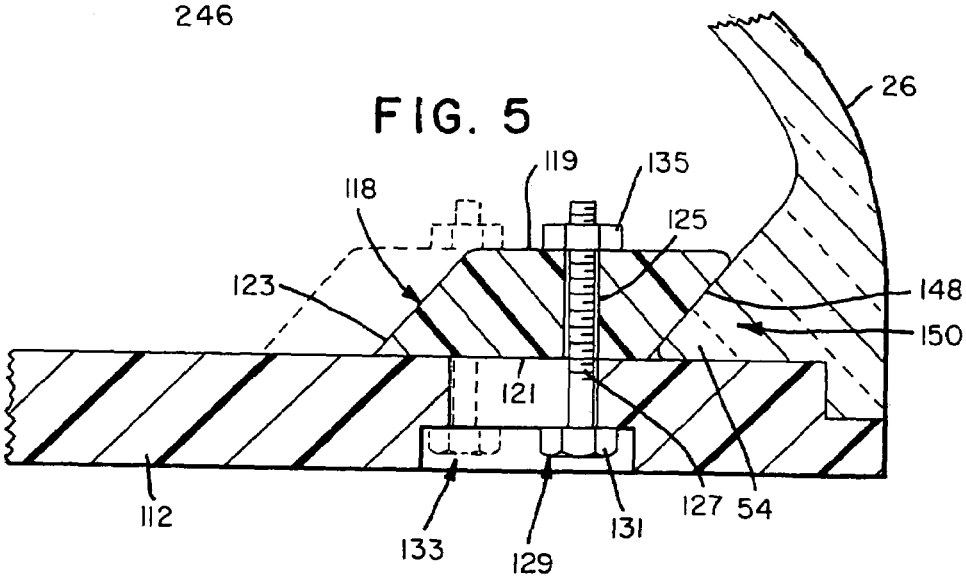

TOILET MOUNTING ASSEMBLY

FIELD OF THE INVENTION

The present invention relates generally to flush closet bowl supports, couplings, seals and fasteners.

BACKGROUND OF THE INVENTION

It has always been difficult to keep fluids contained within a toilet. Outlet blockages can cause bowl overflows. Rough handling can crack porcelain thus permitting tank leaks. Improperly installed wax seals can allow moisture to penetrate unseen into a floor. The result in each case, if not immediately corrected, is rotted floors and substantial repair bills. While the elimination of blockages and rough handling cannot be provided by anyone other than a toilet user, improvements to the known apparatus for mounting toilets can be.

SUMMARY OF THE INVENTION

In light of the problems associated with leaking toilets, it is a principal object of the present invention to provide a toilet mounting assembly that minimizes the potential for leaks and the resultant harm to a building. The assembly does this by firmly anchoring a toilet to a floor, preventing it from rotating about a drain pipe and from rocking back and forth in a manner that would tend to permit a seal to prematurely give way. Further, the assembly itself is formed from durable, non-corroding materials that ensure a long life of service.

It is another object of the present invention to provide a toilet mounting assembly of the type described that permits a toilet to be installed by "snapping" it into place. Quick release of a toilet is also provided by the assembly. As a result, the assembly permits toilets to be quickly and easily installed.

It is a further object of the invention to provide a toilet mounting assembly of the type described that permits a toilet to be easily leveled on an uneven floor. Moreover, the assembly permits the installation of a toilet upon a water-damaged floor without replacement of the floor.

It is an additional object of the present invention to provide a toilet mounting assembly of the type described that, should its seal ever fail, will direct leaking fluids to a location where such will be readily visible to a toilet user. Existing toilet mounts permit leaks to continue undetected for prolonged periods.

It is an object of the invention to provide improved elements and arrangements thereof in a toilet mounting assembly for the purposes described which is lightweight in construction, inexpensive to manufacture, and fully dependable in use.

Briefly, the toilet mounting assembly in accordance with this invention achieves the intended objects by featuring a pedestal for fastening to a floor. The pedestal includes a floor-engaging plate formed of a resilient material with an opening in its center and a groove about its periphery. An upstanding lip is integrally formed with the front of the plate and has a notch in its front. An upstanding lug is integrally formed with the rear of the plate and has an indention in its rear. A head pipe is positioned in the opening in the plate and a gasket is positioned atop the head pipe. A toilet is snap-fit to the pedestal and includes a base that is releasably positioned within the groove in the plate. A fluid outlet in the center of the base is positioned within the opening in the plate and compresses the gasket into the head pipe. A protrusion is provided at the front of the base for snug positioning within the notch in the lip. The protrusion is adapted to temporarily deform the lip so as to gain entry into the notch when being lowered from above. A projection is provided at the rear of the base for positioning within the indention in the lug.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which:

FIG. 1 is an exploded cross-sectional view of a toilet mounting assembly in accordance with the present invention.

FIG. 2 is a top view of the pedestal of the toilet mounting assembly of FIG. 1.

FIG. 3 is a cross-sectional view of the toilet mounting assembly wherein the toilet is positioned upon the pedestal.

FIG. 4 is an enlarged cross-sectional view of an adjustable lip for use with the toilet mounting assembly.

FIG. 5 is an enlarged cross-sectional view of an adjustable lug for use with the toilet mounting assembly.

Similar reference characters denote corresponding features consistently throughout the accompanying drawings.

DETAILED DESCRIPTION OF THE PREFERRED EMBODIMENTS

Referring now to the FIGS., a toilet mounting assembly in accordance with the present invention is shown at 10. Assembly 10 includes a pedestal 12 that can be affixed to a floor 14. The front of pedestal 12 has an upstanding lip 16 for firmly grasping the front of a toilet 25. The rear of pedestal 12, however, has an upstanding lug 18 for firmly grasping the rear of toilet 25. An opening 20 is provided in pedestal 12 through which fluids from the outlet 22 of toilet 25 drain into a head pipe 24 penetrating floor 14 for disposal.

Pedestal 12 is a rectangular plate of resilient plastic whose rear end is rounded off so as to have an outline like that of the base 26 of toilet 25. The pedestal 12 is provided with a peripheral groove 28 into which base 26 can be snugly inserted and a peripheral flange 30 beneath groove 28 for supporting base 26 above floor 14. Since the configurations of toilet 25 and base 26 are largely a matter of design choice, the outline of pedestal 12 and the dimensions of groove 28 and flange 30 can be varied as desired.

Pedestal 12 is provided with a pair of apertures 32 at its front and a pair of apertures 34 at its rear for the passage of threaded fasteners 36. Fasteners 36 are screwed into floor 14 to affix pedestal 12 to floor 14. Preferably, fasteners 36 are stainless steel or nylon screws known for their strength, durability, and resistance to corrosion.

Opening 20 is positioned in the center of pedestal 12. As shown, opening 20 is circular in outline and has a diameter sufficient to permit the passage of head pipe 24. Additionally, opening 20 is provided with a countersunk portion 38 of increased diameter at its top that is sized to snugly receive a circular flange 40 formed at the top of head pipe 24. The depth of countersunk portion 38 is adequate to maintain the top of flange 40 flush with the top of pedestal 12.

Upstanding lip 16 projects upwardly and forwardly from the top of pedestal 12 between apertures 32. Lip 16 includes an upright portion 42 that is affixed at its bottom to the top of pedestal 12. Lip 16 also includes a recumbent portion 44 that is rounded at its front and affixed at its rear to the top of upright portion 42. Thus, recumbent portion 44 projects forwardly from upright portion 42 and defines a notch 46 between its bottom and the top of pedestal 12.

An alternate lip 216 is illustrated in FIG. 4. Preferably, lip 216 projects upwardly and forwardly from the top of a pedestal 212 that, aside from differences in lip features, is identical to pedestal 12. Lip 216 includes an upright portion 242 that is affixed at its bottom to the top of pedestal 212. Lip 216 also includes a recumbent portion 244 with a rear end that is slidably inserted into a cavity 250 in the front of upright portion 242 and a rounded front end that projects from cavity 250. So, recumbent portion 244 projects forwardly from upright portion 242 and defines a notch 246 between its bottom and the top of pedestal 212.

A compressed spring 252 is positioned within cavity 250 to urge recumbent portion 244 from cavity 250. At its front end, spring 252 presses against recumbent portion 244. The rear end of spring 252, on the other hand, presses against upright portion 242.

A set screw 254 passing through the top of upright portion 242 into cavity 250 prevents the escape of recumbent portion 244 from cavity 250. The bottom of set screw 254 penetrates a channel 256 having an inner end 258 within the top of recumbent portion 244. End 258 serves as a stop for engaging set screw 254 and preventing the escape of recumbent portion 244 from cavity 250.

Like lip 16, upstanding lug 18 is integrally formed with pedestal 12. Upstanding lug 18 projects upwardly and rearwardly from the top of pedestal 12 between apertures 34 and has a rearward surface 48 that also projects upwardly and rearwardly from the top of pedestal 12. Thus, between rearward surface 48 and the top of pedestal 12, an indentation 50 is formed.

A movable lug 118 is illustrated in FIG. 4 that can be incorporated into assembly 10 in place of lug 18. Lug 118, has a cross-sectional configuration like that of a parallelogram with a horizontal top surface 119, horizontal bottom surface 121 and rearwardly projecting forward and rearward surfaces 123 and 148. Between rearward surface 148 and the top of pedestal 112, an indentation 150 is formed.

At least one vertical bore 125 penetrates lug 118 for the passage of the threaded shaft 127 of a bolt 129. The head 131 of bolt 129 resides in a countersunk slot 133 provided in the rear of pedestal 112. Slot 133 is oriented so as to permit bolt 129 and lug 118 to be moved forwardly or rearwardly relative to pedestal 112. Rotation of a nut 135 threaded upon shaft 127 permits bolt 129 and lug 118 to be selectively affixed to pedestal 112.

Base 26 of toilet 25 is configured to be snap-fit upon pedestal 12. As shown, the front of base 26 is provided with a protrusion 52 adapted for snug positioning within notch 46 defined by upstanding lip 16. Similarly, the rear of base 26 is provided with a projection 54 adapted for snug positioning within indentations 50 or 150 defined by either of upstanding lugs 18 or 118. The tight fit of protrusion 52 within notch 46 and projection 54 within indentation 50 prevents toilet 25 from being easily tipped over, rotated or otherwise moved once snapped into position upon pedestal 12.

To prevent fluid leaks, outlet 22 of toilet 25 is provided with a tapered bottom end 56 for positioning within flange 40 of head pipe 24. A peripheral shoulder 58, projecting from outlet 22 adjacent tapered bottom end 56, provides a seat for a rubber gasket 60 positioned about tapered bottom end 56. The countersunk, top portion 62 of passageway 64 through head pipe 24 engages the bottom of gasket 60, pressing gasket 60 against tapered bottom end 56 and shoulder 58 to form a fluid-tight seal.

The bottom of head pipe 24 is inserted into the top of a drain pipe 66 that conveys fluids to a remote location for disposal. A rubber seal 68 is fitted over the top of drain pipe 66 that snugly, yet slidably, engages the bottom of head pipe 24 to prevent fluid leaks. These features, thus permit the use of toilet mounting assembly 10 can be accomplished without resort to the special tools of a welder or pipe fitter.

The use of toilet mounting assembly 10 is straightforward. First, pedestal 12 is secured to floor 14 by fasteners 36 at a location where opening 20 is axially aligned with drain pipe 66. Next, seal 68 is positioned atop drain pipe 66. Then, the bottom of head pipe 24 is inserted into drain pipe 66 and engaged with seal 68. Once gasket 60 is positioned upon circular flange 40 of head pipe 24, pedestal 12 is ready to receive toilet 25.

Toilet 25 is gently positioned atop pedestal 12. Base 26 is then tipped rearwardly so that its rear end rests upon flange 30. Next, wedge-like projection 54 in base 26 is inserted into indention 50 defined by lug 18. Then, base 26 is tipped forwardly so that tapered end 56 of outlet 22 passes into countersunk portion 62 of passageway 64 and engages the center of gasket 60 and protrusion 52 "snaps" into notch 46 defined by lip 16 with the rounded front end of recumbent portion 44 and the resilient nature of the material comprising lip 16 facilitating the entry of protrusion 52 into notch 46. After connecting the usual water supply conduit (not shown) to toilet 25, toilet 25 is ready for use. The entire toilet installation process utilizing assembly 10 requires only a few minutes to complete as opposed to an hour or more using conventional methods.

Should toilet mounting assembly 10 be supplied with a movable lug 118, a single pedestal 112 can be employed with toilets 25 having a variety of base 26 configurations. By sliding lug 118 forward or rearward and clamping such in place by means of nut 135, toilets 25 having different spacings between their protrusions 52 and projections 54 can be accommodated. Determining the precise location for clamping lug 118 in place can be determined quickly by trial and error. Alternatively, indicia (not shown) can be provided upon pedestal 112 at the time of manufacture that would indicate clamping points for a variety of makes and models of toilets 25.

In the end, toilet mounting assembly 10 is easy to use. Assembly 10 permits a toilet 25 to be easily connected to floor 14. In the event that toilet 25 becomes broken, such can be easily disconnected from floor 14 simply by lifting up upon the front of toilet 25 with a moderate force to disconnect base 26 from pedestal 12 and, then, toilet 25 can be taken to a remote location for repair. With assembly 10, replacement of toilet 25 is a "snap."

While toilet mounting assembly 10 has been described with a high degree of particularity, it will be appreciated by those skilled in the art that modifications may be made thereto. Therefore, it is to be understood that the present invention is not limited to the embodiments described above, but encompasses any and all embodiments within the scope of the following claims.

I claim:

1. A toilet mounting assembly, comprising:

a pedestal for fastening to a floor, said pedestal including:

a plate for positioning upon a floor and having an opening in its center;

an upstanding lip being affixed to the front of said plate and being formed from a resilient material and having a notch in its front;

an upstanding lug being slidably affixed to the rear of said plate and having an indention in its rear; and, a toilet snap-fit to said pedestal, said toilet including:

a base for positioning upon said plate;

a fluid outlet in the center of said base for positioning within said opening in said plate;

a protrusion at the front of said base for snug positioning within said notch in said lip, said protrusion temporarily deforming said lip to gain entry into said notch; and, a projection at the rear of said base for positioning within said indention in said lug.

2. The toilet mounting assembly according to claim 1 wherein said plate is provided with a plurality of spaced-apart apertures for the passage of threaded fasteners for fastening said plate to a floor.

3. The toilet mounting assembly according to claim 1 wherein said base of said toilet is a ring and said plate is provided with a peripheral groove for fully receiving said base.

4. The toilet mounting assembly according to claim 1 wherein said opening has a countersunk portion of increased diameter at its top and said assembly further comprises a head pipe having a circular flange being positioned within said countersunk portion.

5. The toilet mounting assembly according to claim 4 wherein said fluid outlet has a tapered bottom end being positioned within said circular flange of said head pipe and a peripheral shoulder being located adjacent said tapered bottom end and said assembly further comprises a gasket being positioned about said tapered bottom end and being compressed by said peripheral shoulder into said circular flange so as to form a fluid-tight seal between said fluid outlet and said head pipe.

6. The toilet mounting assembly according to claim 1 wherein said plate is provided with a countersunk slot trending from the front to the back of said plate and said assembly further comprises a threaded fastener slidably positioned in said countersunk slot for fastening said lug to said plate.

7. A toilet mounting assembly, comprising:

a pedestal for fastening to a floor, said pedestal including:

a plate being formed of a resilient material for positioning upon a floor, said plate having an opening with a countersunk portion in its center and also having a groove about its periphery;

an upstanding lip being integrally formed with said plate of a resilient material and extending upwardly from the front of said plate, said lip having a notch in its front, said lip further including:

an upright portion being affixed at its bottom to the top of said plate, said upright portion having a cavity in its front;

a recumbent portion having a rear end slidably positioned within said cavity, said recumbent portion also having a rounded front end projecting forwardly from said cavity so as to define said notch between the bottom of said recumbent portion and the top of said plate; and, a compressed spring being positioned within said cavity for urging said recumbent portion from said cavity;

an upstanding lug being integrally formed with said plate of a resilient material and extending upwardly from the rear of said plate, said lug having an indention in its rear;

a head pipe positioned in said opening in said plate, said head pipe having a circular flange at its top being snugly positioned within said countersunk portion of said opening;

a gasket positioned atop said circular flange of said head pipe;

a toilet snap-fit to said pedestal, said toilet including:

a base being releasably positioned within said groove about the periphery of said plate;

a fluid outlet in the center of said base being positioned within said opening in said plate and compressing said gasket;

a protrusion at the front of said base for snug positioning within said notch in said lip, said protrusion being adapted to temporarily deform said lip so as to gain entry into said notch; and, a projection at the rear of said base for positioning within said indention in said lug.

* * * * *